US007399173B2

(12) United States Patent
Swanson

(10) Patent No.: US 7,399,173 B2
(45) Date of Patent: Jul. 15, 2008

(54) APPARATUS FOR FLEXING A WEB

(75) Inventor: Ronald P. Swanson, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 771 days.

(21) Appl. No.: 10/806,957

(22) Filed: Mar. 23, 2004

(65) Prior Publication Data

US 2005/0246965 A1 Nov. 10, 2005

(51) Int. Cl.
*B29C 61/10* (2006.01)

(52) U.S. Cl. ..... 425/145; 425/371; 425/445; 493/461

(58) Field of Classification Search ..... 425/135, 425/145, 363, 371, 445; 264/280; 493/461, 493/465

See application file for complete search history.

(56) References Cited

U.S. PATENT DOCUMENTS

| | | | |
|---|---|---|---|
| 16,384 | A | 1/1857 | Hamblen |
| 236,068 | A | 12/1880 | Newcomb |
| 273,040 | A | 2/1883 | Dexter |
| 478,255 | A | 7/1892 | Edwards et al. |
| 751,527 | A | 2/1904 | Marr |
| 754,797 | A | 3/1904 | Ostrander |
| 1,167,036 | A | 1/1916 | Witham, Sr. et al. |
| 1,191,297 | A | 7/1916 | Gardner |
| 1,238,742 | A | 9/1917 | Butler |
| 1,288,643 | A | 12/1918 | Mayer |
| 1,432,832 | A | 10/1922 | Brockett |
| 1,469,875 | A | 10/1923 | Beauregard |
| 1,481,866 | A | 1/1924 | Heist |
| 1,654,946 | A | 1/1928 | Sinks |
| 1,691,023 | A | 11/1928 | Dye |
| 1,792,596 | A | 2/1931 | Livingston |
| 1,880,451 | A | 10/1932 | Hopkins |
| 1,891,782 | A | 12/1932 | Sager |
| 2,027,564 | A | 1/1936 | Stein et al. |
| 2,028,700 | A | 1/1936 | Guier |

(Continued)

FOREIGN PATENT DOCUMENTS

| | | |
|---|---|---|
| EP | 0 658 505 A1 | 6/1995 |

(Continued)

OTHER PUBLICATIONS

U.S. Appl. No. 11/861,742, Swansan et al., "System and Method for Controlling Curl in Multilayer Webs," filed Sep. 26, 2007.

(Continued)

*Primary Examiner*—James Mackey

(57) ABSTRACT

An apparatus and method for flexing a web is disclosed. The web passes over two co-rotating members, such as rollers or belts, which are separated by a small adjustable gap. The web travels around the first rotating member, is peeled off in the vicinity of the gap, bent back on itself in a small radius and reattached on the second co-rotating member. The location of the small radius is fixed with a closed loop control system sensing the radius location and controlling the relative velocity of the two members. Strain in the web is adjusted with the size of the small radius, which is controlled by the adjustable gap and radius location.

11 Claims, 7 Drawing Sheets

U.S. PATENT DOCUMENTS

| | | | |
|---|---|---|---|
| 2,037,825 | A | 4/1936 | Salfisberg |
| 2,066,872 | A | 1/1937 | Adams et al. |
| 2,070,505 | A | 2/1937 | Beck |
| 2,137,887 | A | 11/1938 | Abbott |
| 2,141,318 | A | 12/1938 | Salfisberg |
| 2,152,101 | A | 3/1939 | Scherer |
| 2,184,744 | A | 12/1939 | Jonassen |
| 2,259,362 | A | 10/1941 | Young |
| 2,293,178 | A | 8/1942 | Stocker |
| 2,307,817 | A | 1/1943 | Austin |
| 2,334,022 | A | 11/1943 | Minich |
| 2,335,190 | A | 11/1943 | Minich |
| 2,339,070 | A | 1/1944 | Hayes |
| 2,348,162 | A | 5/1944 | Warner |
| 2,370,811 | A | 3/1945 | Osgood, Jr. |
| 2,373,040 | A | 4/1945 | Macdonald et al. |
| 2,398,822 | A | 4/1946 | Faris et al. |
| 2,403,482 | A | 7/1946 | Cloud |
| 2,411,774 | A | 11/1946 | Gundelfinger |
| 2,412,187 | A | 12/1946 | Wiley et al. |
| 2,434,111 | A | 1/1948 | Hawley, Jr. et al. |
| 2,454,999 | A | 11/1948 | Eaton |
| 2,468,697 | A | 4/1949 | Wiley |
| 2,483,339 | A | 9/1949 | Gardner et al. |
| 2,490,781 | A | 12/1949 | Cloud |
| 2,505,146 | A | 4/1950 | Ryan |
| 2,531,619 | A | 11/1950 | Gonia |
| 2,540,986 | A | 2/1951 | Klein et al. |
| 2,545,868 | A | 3/1951 | Bailey |
| 2,547,836 | A | 4/1951 | Pfeiffer |
| 2,559,365 | A | 7/1951 | Middleton et al. |
| 2,559,705 | A | 7/1951 | Borkland |
| 2,578,899 | A | 12/1951 | Pace, Jr. |
| 2,582,165 | A | 1/1952 | Rosenfeld |
| 2,597,877 | A | 5/1952 | LeClair |
| 2,600,295 | A | 6/1952 | Hommel |
| 2,618,012 | A | 11/1952 | Milne |
| 2,658,432 | A | 11/1953 | Baumgartner |
| 2,660,218 | A | 11/1953 | Johnson et al. |
| 2,698,982 | A | 1/1955 | Smith et al. |
| 2,702,406 | A | 2/1955 | Reed |
| 2,737,089 | A | 3/1956 | Baumgartner |
| 2,745,134 | A | 5/1956 | Collins |
| 2,893,053 | A | 7/1959 | Powell |
| 2,918,891 | A | 12/1959 | Klabunde |
| 2,918,897 | A | 12/1959 | Zernov |
| 2,976,924 | A | 3/1961 | Baxter, Jr. |
| 3,044,228 | A | 7/1962 | Peterson |
| 3,076,492 | A | 2/1963 | Monks |
| 3,344,493 | A | 10/1967 | Telgheider |
| 3,366,298 | A | 1/1968 | Bahrani |
| 3,373,288 | A | 3/1968 | Otepka et al. |
| 3,498,878 | A | 3/1970 | Obenshain |
| 3,510,036 | A | 5/1970 | Lewis, Jr. et al. |
| 3,552,668 | A | 1/1971 | Kanno |
| 3,567,093 | A | 3/1971 | Johnson |
| 3,604,652 | A | 9/1971 | Sleeper |
| 3,724,732 | A | 4/1973 | Bonner |
| 3,774,831 | A | 11/1973 | Paradine |
| 3,799,038 | A | 3/1974 | Bossons et al. |
| 3,831,828 | A | 8/1974 | Royon et al. |
| 3,890,547 | A | 6/1975 | Keck |
| 3,913,729 | A | 10/1975 | Andrews |
| 3,939,025 | A | 2/1976 | Kane |
| 3,974,952 | A | 8/1976 | Swanke et al. |
| 3,976,528 | A | 8/1976 | James |
| 4,002,047 | A | 1/1977 | MacPhee et al. |
| 4,013,284 | A | 3/1977 | Demetre |
| 4,033,492 | A | 7/1977 | Imai |
| 4,060,236 | A | 11/1977 | Carstedt |
| 4,069,081 | A | 1/1978 | Drower et al. |
| 4,069,959 | A | 1/1978 | Bartell et al. |
| 4,119,309 | A | 10/1978 | Mayer et al. |
| 4,141,735 | A | 2/1979 | Schrader et al. |
| 4,182,472 | A | 1/1980 | Peekna |
| 4,187,113 | A | 2/1980 | Mathews et al. |
| 4,190,245 | A | 2/1980 | Brandes |
| 4,300,891 | A | 11/1981 | Bemiss |
| 4,300,969 | A | 11/1981 | Frydendal |
| 4,322,802 | A | 3/1982 | Lewis et al. |
| 4,342,412 | A | 8/1982 | Lorenz et al. |
| 4,343,991 | A | 8/1982 | Fujiwara et al. |
| 4,360,356 | A | 11/1982 | Hall |
| 4,389,455 | A | 6/1983 | Asao |
| 4,467,949 | A | 8/1984 | Nakata |
| 4,471,816 | A | 9/1984 | Wada |
| 4,539,072 | A | 9/1985 | Frye et al. |
| 4,598,849 | A | 7/1986 | Frye et al. |
| 4,657,614 | A | 4/1987 | Andersson |
| 4,862,565 | A | 9/1989 | Damour |
| 4,917,844 | A | 4/1990 | Komai et al. |
| 4,925,520 | A | 5/1990 | Beaudoini et al. |
| 4,952,281 | A | 8/1990 | Akira |
| 5,043,036 | A | 8/1991 | Swenson |
| 5,124,743 | A | 6/1992 | Shiota |
| 5,141,484 | A | 8/1992 | Akira |
| 5,244,861 | A | 9/1993 | Campbell et al. |
| 5,290,672 | A | 3/1994 | Dunk |
| 5,387,501 | A | 2/1995 | Yajima et al. |
| 5,466,519 | A | 11/1995 | Shirakura et al. |
| 5,517,737 | A | 5/1996 | Viltro et al. |
| 5,560,793 | A | 10/1996 | Ruscher et al. |
| 5,677,050 | A | 10/1997 | Bilkadi et al. |
| 5,853,965 | A | 12/1998 | Haydock et al. |
| 5,866,282 | A | 2/1999 | Bourdelais et al. |
| 5,874,205 | A | 2/1999 | Bourdelais et al. |
| 5,888,643 | A | 3/1999 | Aylward et al. |
| 5,975,745 | A | 11/1999 | Oishi et al. |
| 6,030,742 | A | 2/2000 | Bourdelais et al. |
| 6,152,345 | A | 11/2000 | Griffin et al. |
| 6,272,984 | B1 | 8/2001 | Kato et al. |
| 6,273,984 | B1 | 8/2001 | Bourdelais et al. |
| 6,362,020 | B1 | 3/2002 | Shimoda et al. |
| 6,489,015 | B1 | 12/2002 | Tsuchiya et al. |
| 6,626,343 | B2 | 9/2003 | Crowley et al. |
| 6,686,031 | B2 | 2/2004 | Matsufuji et al. |
| 6,820,671 | B2 | 11/2004 | Calvert |
| 2005/0133965 | A1 | 6/2005 | Yu et al. |
| 2005/0212173 | A1 | 9/2005 | Swansan |
| 2005/0246965 | A1 | 11/2005 | Swanson |

FOREIGN PATENT DOCUMENTS

| | | |
|---|---|---|
| EP | 1 258 555 A1 | 11/2002 |
| JP | 63-171755 | 7/1988 |
| JP | 63171755 | 7/1988 |
| WO | WO 97/32069 | 9/1997 |
| WO | WO 98/56702 | 12/1998 |

OTHER PUBLICATIONS

U.S. Appl. No. 11/861,769, Swansan et al., "System and Method for Controlling Curl in Multilayer Webs," filed Sep. 26, 2007.

APPARATUS FOR FLEXING A WEB

FIELD

The present disclosure generally relates to web handling, and in particular to flexing a web to induce a permanent strain.

BACKGROUND

In web handling operations, curl is often present in multi-layered webs. Curl is defined as the tendency of a web to deviate from a generally flat or planar orientation when there are no external forces on the web. In multi-layered web systems, the curl can be controlled by carefully matching the strains of the webs being laminated together. In products that are direct-coated, such strain matching is much more complicated.

Curl can be controlled in laminated multi-layer webs by carefully matching the strains of the incoming webs. Curl is more difficult to control in direct-coated products, especially where backings are placed under high tension and temperatures, resulting in large strains, while the coating cures at near zero strain. If the induced strain from tension, temperature and cure shrinkage is not matched between the layers, the final product will not lie flat.

Flexing is a process that is used in the process of manufacturing abrasives. Flexing cracks the make-mineral-size coating in the abrasive article. This process makes the abrasive product flexible and reduces the propensity to curl. Sliding the (uncoated) backside of the abrasive over a small radius or pressing abrasive into a rubber roller using a small rotating bar are common flexing techniques. These techniques work very well in the common cases where the product tends to curl toward the abrasive side. These techniques can't be used with the abrasive coated on the contact side because of product damage and tool wear.

Polymer backed abrasive products will have a propensity to curl toward the backing side when direct coated. Minimum line tensions and cure temperatures along with maximum cure shrinkage and backing modulus can help minimize curl problems, but have limitations. If such optimization still results in unacceptable product curl, excess tensile strain will need to be removed from the backing. This could be done with thermal stress relief or by mechanically yielding the backing. Bending the backing around the outside of a small radius on an object will stress the backing to its yield point, causing permanent elongation in the backing.

SUMMARY

An aspect of the invention of the present disclosure is directed to a system for flexing a web in a cross-direction. The system includes a web handling apparatus having a web path, wherein the web path includes means for flexing the web to induce a plastic strain in the cross-direction of the web. In certain embodiments, the means for flexing includes a belt assembly including first and second belts, the first belt having a first surface and first surface having a first line of travel and the second belt including a second surface having a second line of travel, wherein the first and second lines of travel are oriented at an angle with respect to one another. In certain embodiments, the lines of travel are oriented substantially perpendicularly.

An aspect of the invention of the present disclosure is directed to a system for imparting permanent cross-directional strain in a web. The system includes a web handling apparatus including first flexing assembly. The first flexing assembly includes a first belt and a second belt and a gap therebetween. A web path is formed through the first flexing assembly; and the web path includes a first portion along the first belt, a second portion along the second belt and a third portion in the gap between first and second belts. The third portion includes a radiused segment including a radius and the radius being sufficiently small to impart a permanent strain in the web. The direction of travel of the first portion of the web path is angled with respect to the direction of travel of the second portion of the web path.

An aspect of the invention of the present disclosure is directed to a method of flexing a web. The method includes creating a web path, wherein the web path includes a first portion along a first web handling assembly, a second portion along a second web handling assembly, and a third portion in a gap between first and second web handling assemblies, wherein the third portion includes a radiused segment having a radius. The direction of travel of the first portion of the web path is substantially perpendicular to the direction of travel of the second portion of the web path. A web is passed through the web path to induce a plastic, cross-directional strain in the web.

BRIEF DESCRIPTION OF THE DRAWINGS

The present disclosure will be further explained with reference to the appended figures wherein like structures are referred to by like numerals throughout the several views, and wherein.

DETAILED DESCRIPTION

In the following detailed description, reference is made to the accompanying drawing that forms a part hereof, and in which is shown by way of illustration exemplary embodiments in which the disclosure may be practiced. It is to be understood that other embodiments may be utilized, and structural or logical changes may be made without departing from the scope of the present disclosure. The following detailed description, therefore, is not to be taken in a limiting sense, and the scope of the present disclosure is defined by the appended claims.

Generally, the present disclosure is directed to a system and method for inducing a cross-directional strain in a web, which can be used to remove curl from a web. Alternatively, the system can also be used to impart a predetermined curl to the web. The system and method can be used with webs having a single or multiple layers. The system includes a flexing assembly having first and second belts having a gap therebetween. First and second belts cooperate to create a webpath wherein the web enters the first belt in a first orientation and is flipped in the gap before contacting the second belt, which then urges the web in a second orientation different from the first. Typically, for even strain distribution across the web, the first and second orientations are substantially perpendicular, though they can be angled more or less, depending on the desired strain distribution. Also, multiple flexing assemblies can be used, wherein each assembly imparts strain to the web in a different direction.

The belts are placed in proximity so that a desired gap is created therebetween. A web path is created that passes over a portion of the first belt, through the gap, and then over the second belt. A web passing through the web path includes a radiused portion in the gap. The radiused portion of the web is controlled to a predetermined radius. The predetermined radius is selected to impart a set strain on the web. The predetermined radius can vary with time, as will be described hereinafter.

Figure 1:
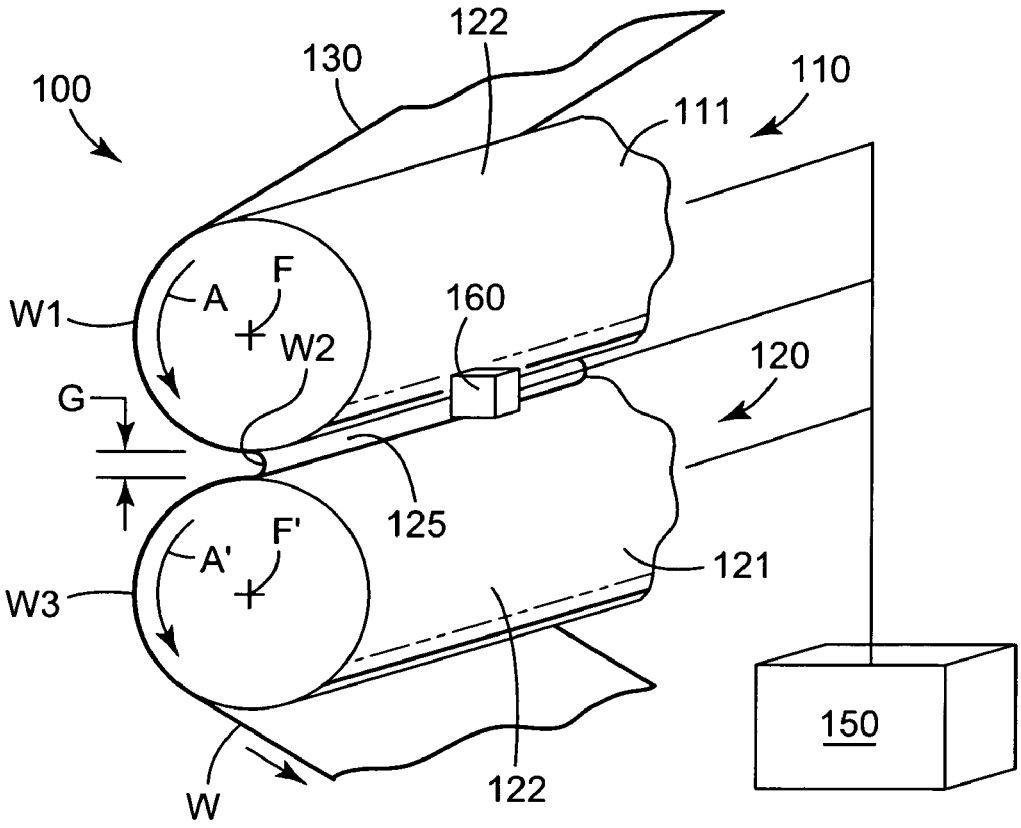
FIG. 1 is a perspective view of an example embodiment of a system according to the present disclosure.
Figure 1A:
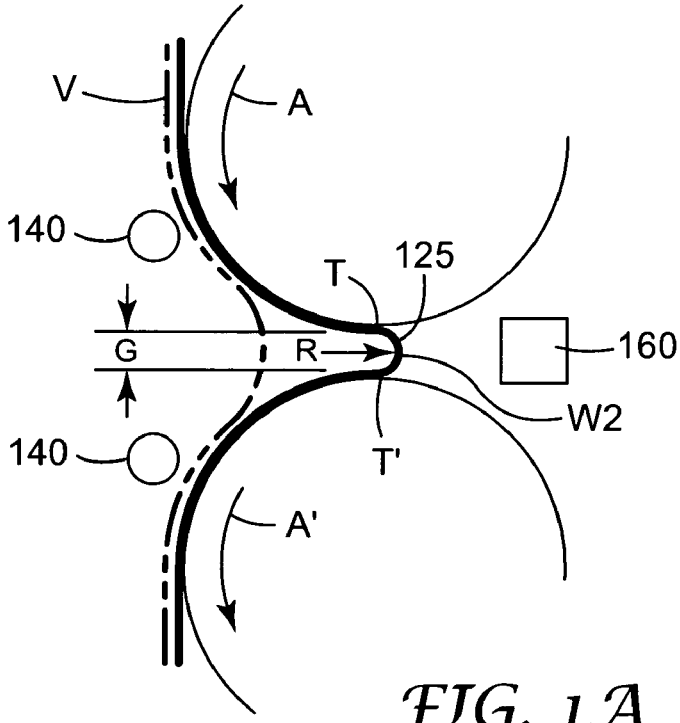
FIG. 1A is a close-up view of a section of the system of FIG. 1.

Referring to FIGS. 1-1A, an exemplary embodiment of a system 100 for flexing a web to induce a permanent strain in the web is shown. The system 100 includes a first rotating assembly 110 and a second rotating assembly 120. In the example embodiment illustrated, first and second rotating assemblies 110, 120 are roller assemblies 111, 121. Each roller assembly 111, 121 includes a roller 112, 122 and means for supporting the roller (such as a frame connected to roller bearing (not shown)). Each roller is driven and controlled by a control system 150, as will be described further below. A gap G is created when the rollers are placed in close proximity. Generally, the gap G is defined by the location where the first and second rollers are nearest one another.

Roller assemblies 111, 121 co-rotate, which means they rotate in the same direction A, A' relative to a fixed axis of each roller. A web path W is formed through the system 100. The web path W includes a first portion W1 passing over the first roller 112, a second portion W2 passing into or through the gap G, and a third portion W3 passing over the second roller 122. The second portion W2 of the web path W is controlled to form a radiused portion 125. By passing a web 130 through the radiused portion W2, the web can be flexed and a strain induced in the web in the machine direction, that is, the direction along the direction in which the web travels. The amount of strain induced in the web is a function of the bend radius R of the radiused portion 125. By flexing a web above its plastic deformation or plastic yield point, which is typically around 0.2% for typical metals and 2.0% for typical plastics, a permanent strain can be imparted to the flexed portion of the web. One skilled in the art will recognize that the elastic limit of a web can be determined by a variety of standard measurement techniques, such as that done using a mechanical tester, for example Model 4505, available from INSTRON Co., of Canton, Mass.

To flex the web, the web is passed over the two co-rotating members and through the gap. Typically, the web is held against the co-rotating members by holding means such as, for example, an electrostatic pinning wire (140 as is illustrated in FIG. 1A), air pressure or vacuum, adhesives, or engagement members, for example, hook and loop fasteners. Using the holding means allows control of where the web leaves and enters points T, T' of the respective co-rotating members. It also counteracts the tendency of the web to move out of the gap, such tendency being caused by the rollers rotating in the same direction. One example of a holding means that can be used to hold the web against the co-rotating members is a charging bar with a trade designation TETRIS, available from SIMCO Industrial Static Control, Hatfield, Pa.

Generally, the web travels around the first co-rotating member and is peeled off at point T in the vicinity of the gap. The web is then bent back on itself in a small radius R (at the radiused portion 125) and reattached at a point T' on the second co-rotating member. In the example embodiment described, the location of the radiused portion 125 is fixed with a closed loop control system 150 sensing the radiused portion's 125 location and controlling the relative velocity of the two rotating members.

The size of the radius R of the web can be varied by controlling the size of the gap and the distance that the web extends into or through the gap. In one exemplary embodiment, the web radius R can be controlled by using a sensor 160 to sense the position of the radiused portion 125 in the gap G (for a fixed gap dimension), since the curvature (radius) of the radiused portion 125 will depend on the distance that the portion 125 extends into the gap, the material thickness, and the tangent points T, T' at which the web loses contact with the rollers. Once the relationship of the web curvature of the radiused portion 125 is determined, a sensor 160 is used to measure the position of the radiused portion 125 of the web while in the gap G. The sensor 160 can then send a signal to the means for controlling the rollers, such as a programmable controller, which can then adjust operation of the system to position the radiused portion 125 to obtain the desired curvature. For example, if the sensor detects that the radiused portion 125 has moved too far into the gap G, it can adjust the relative speed of the rollers to reposition properly the radiused portion 125 in the gap G. One way would be to increase the speed of the second roller relative to the first roller, which would tend to move the radiused portion 125 towards the gap G. Alternatively, the speed of the first roller could be decreased relative to the speed of the second roller until the radiused portion 125 is repositioned as desired. Upon reading this disclosure, other means for properly positioning the radiused portion of the web in the gap G will become apparent to one having the knowledge and skill of one of ordinary skill in the art, such as using a pacing roll and a follower roll.

Figure 2:
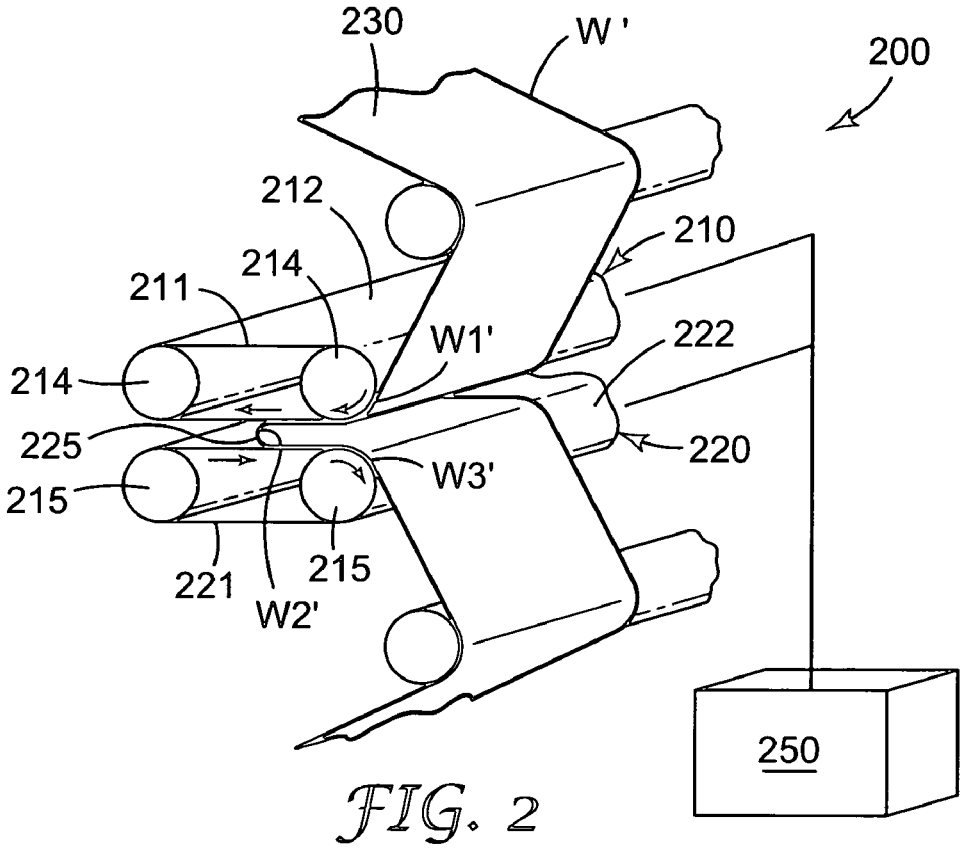
FIG. 2 is a perspective view of another example embodiment of a system according to the present disclosure.

The example embodiment described above can be operated to remove/add curl to/from a web. The system can be integrated into a web handling process machine, such as a printing press, or it can be used as a separate operation to remove/add curl from/to a product. To control the amount of curl, a web is positioned along the web path described above. The radiused portion is then controlled by sensing the position of the radiused portion when the web is traveling, and correction is made by controlling the relative speed of the rollers to adjust the position as desired. Typically, it is preferred that the radiused portion extend through the narrowest point in the gap, as is illustrated in FIGS. 1 and 2. However, it may be desirable for the radiused portion to extend into the gap to a lesser extent and not through the point at which the rotating members are nearest to one another, as shown by web path V. When the rotating assemblies are rollers, the size of the radiused portion is sensitive to the amount that the radiused portion extends towards or into the gap, as well as the gap size. This sensitivity can be made to be only a function of the gap size, as will be discussed below.

Figure 2A:
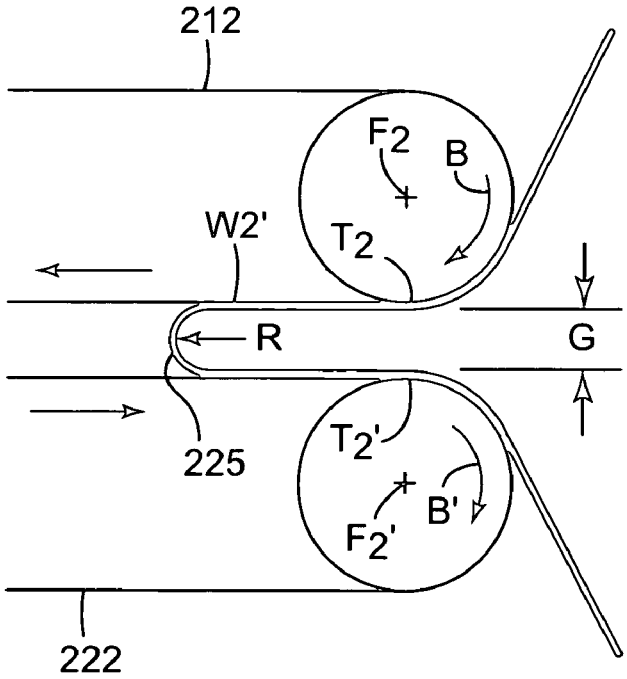
FIG. 2A is a close-up view of a section of the system of FIG. 2.

Referring to FIGS. 2-2A, another exemplary embodiment of a system 200 for flexing a web to induce a permanent strain in the web is shown. The system 200 includes a first rotating assembly 210 and a second rotating assembly 220. In the example embodiment illustrated, first and second rotating assemblies 210, 220 are belt assemblies 211, 221. Each belt assembly 211, 221 includes a driven belt 212, 222 and means for supporting the belt (such as a frame connected to rollers 214, 215 not shown). Each belt 212, 222 is driven and controlled by a control system 250, as will be described further below.

Belt assemblies 212, 222 co-rotate, which means they rotate in the same direction B, B' relative to a fixed axis F2, F2'. A web path W' is formed through the system 200. The web path W' includes a first portion W1' passing over the first belt 212, a second portion W2' passing through the gap G', and a third portion W3' passing over the second belt 222. The second portion W2' of the web path W' is controlled to form a radiused portion 225. By passing a web 230 through the radiused portion W2', the web 230 can be flexed and a strain induced in the web in the machine direction, that is, the direction along the direction in which the web travels.

As long as the radiused portion 225 of the web is located between the respective ends of the first and second belts forming the gap G, the curvature of the radiused portion 225 is only a function of the size of the gap G, since the tangent T2 at which the web 230 leaves the first belt 212 and rejoins the second belt 222 is constant between the ends of the first and second belts 212, 222, as long as the belts are substantially parallel along their respective flat portions. Thus, once the radiused portion 225 is formed while the system is operating, the system can be run without a sensor for detecting the position of the radiused portion 225 of the web 230 in the gap G. However, since there is typically some drift of the position of the radiused portion 225 of the web 230 in the gap G, it is typical to have a sensor detect the position of the radiused portion to keep the radiused portion 225 positioned within the gap G. Such a sensor would require less sensitivity than the sensor required for the example embodiment using rollers.

The exemplary embodiments described previously are particularly well suited for inducing a strain that is relatively constant in a cross-directional orientation on the web. As discussed, the strain can be varied as a function of the machine direction, but the strain is not varied in the cross-direction. However, in certain situations, it may be desirable to create a strain in a cross-direction of the web. Such a system would be suitable to remove curl from a web that varied as a function of the cross-direction of the web.

Figure 3:
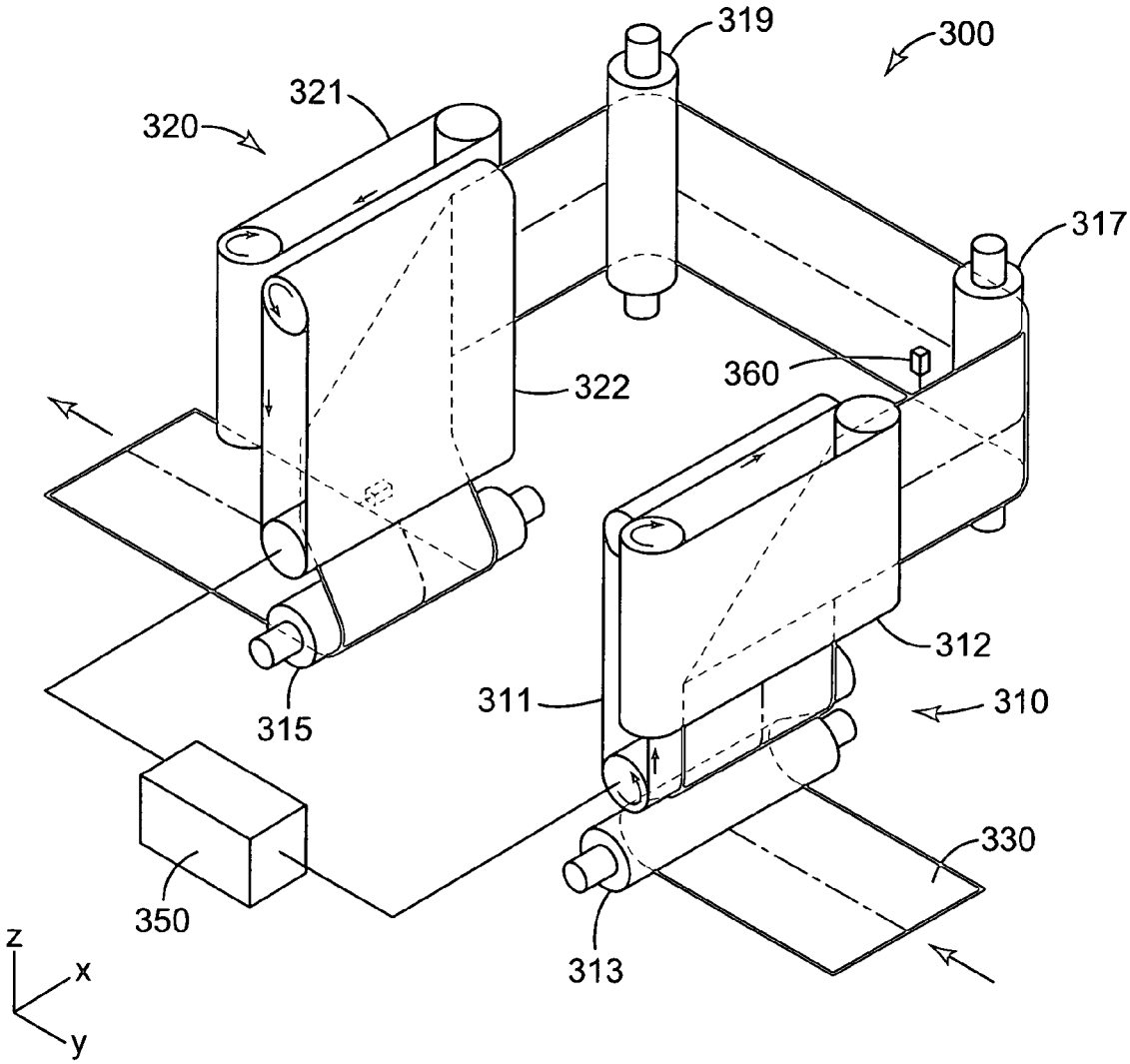
FIG. 3 is a perspective view of another example embodiment of a system according to the present disclosure.
Figure 3A:
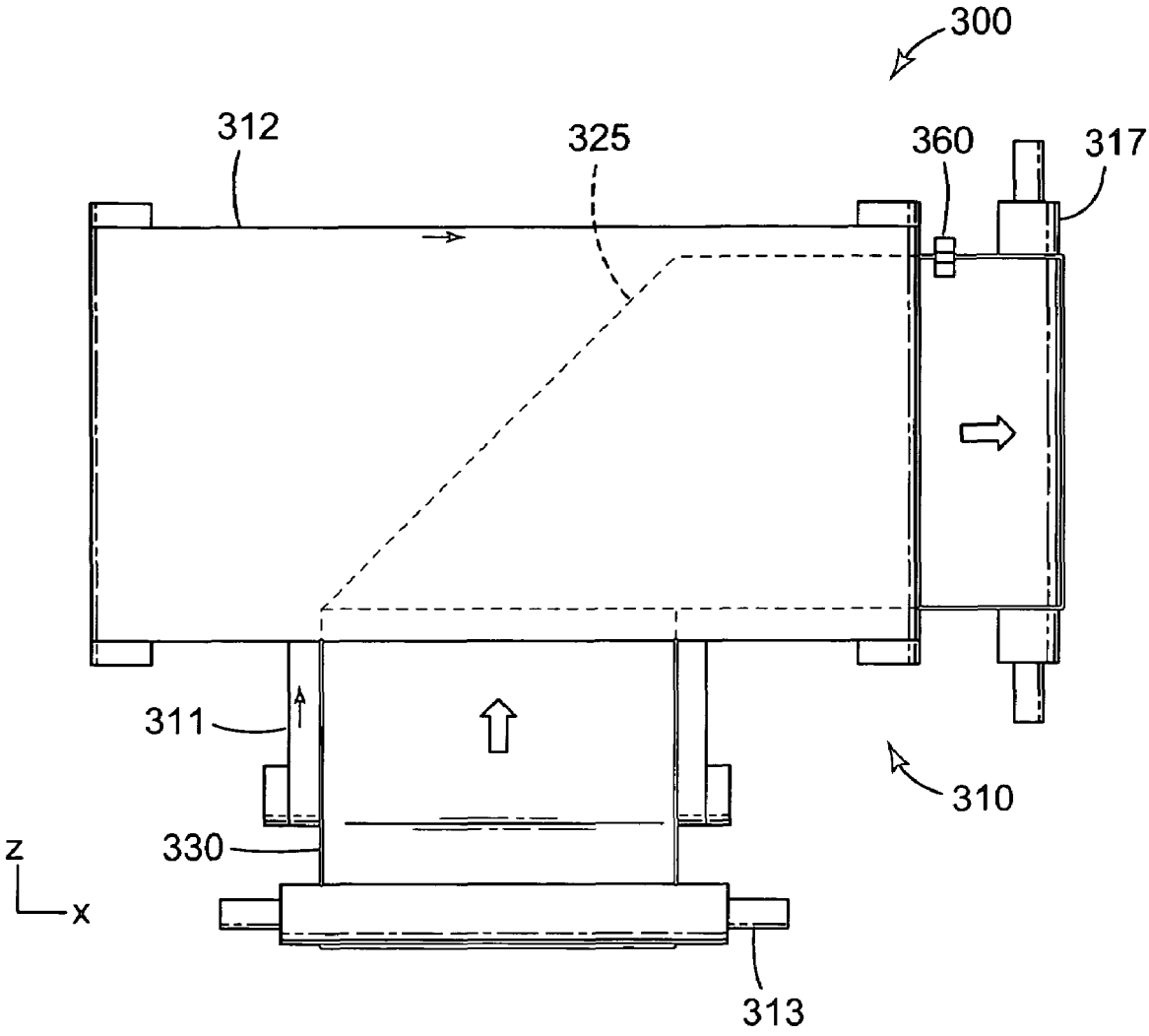
FIG. 3A is a side view of an exemplary flexing assembly of the system of FIG. 3 according to the present disclosure.
Figure 3B:
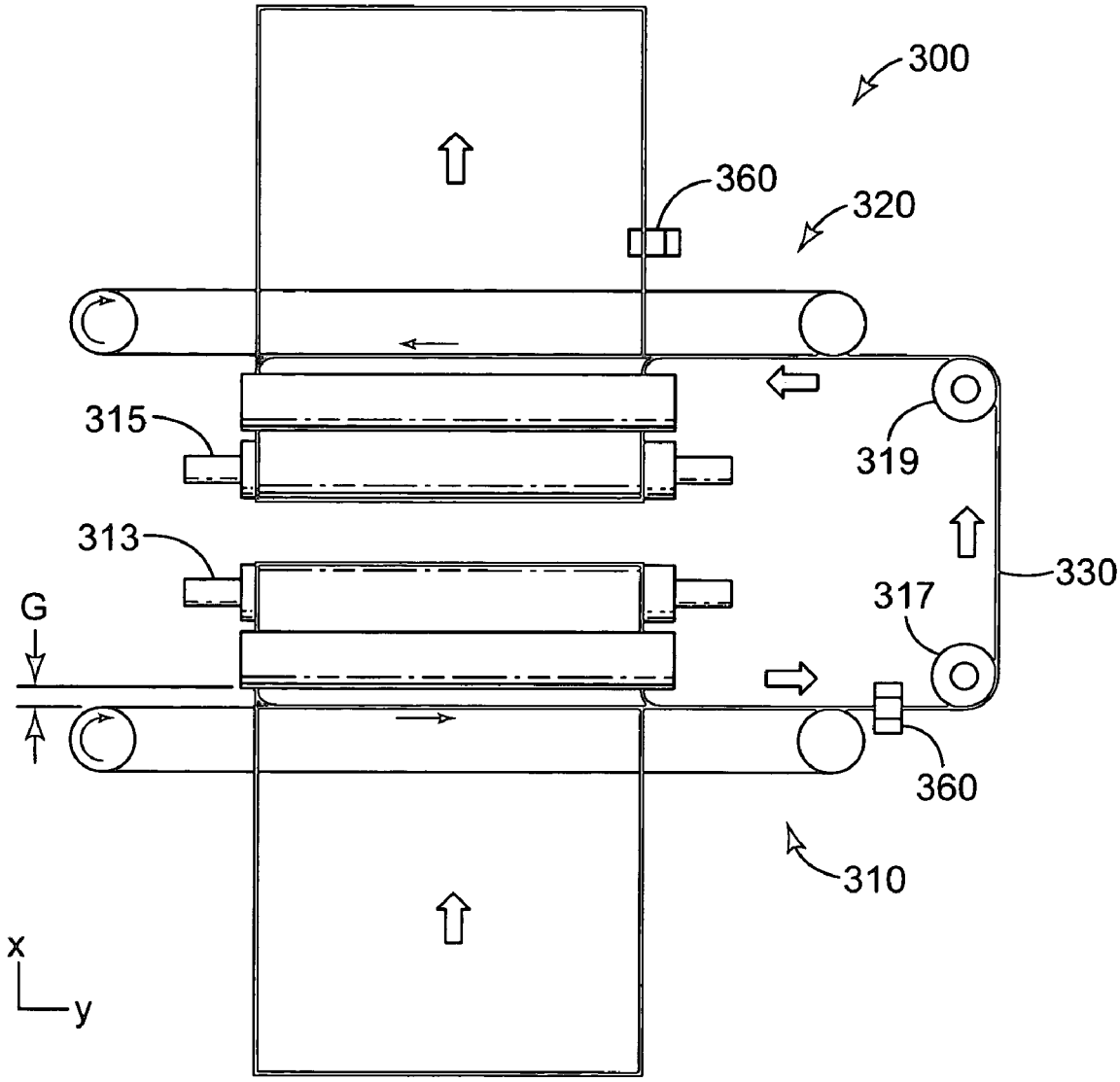
FIG. 3B is a top view of the flexing assembly of FIG. 3A.
Figure 3C:
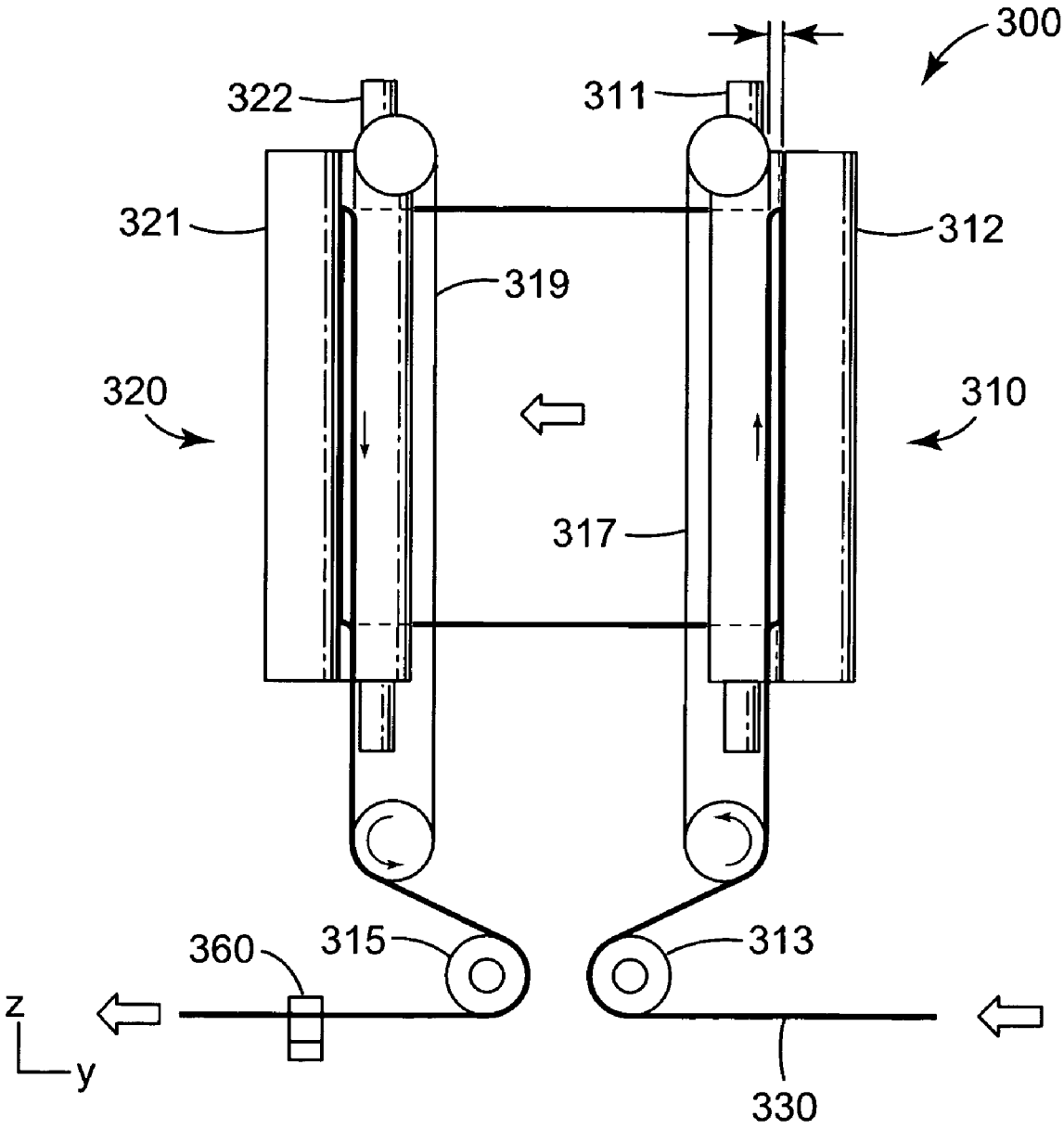
FIG. 3C is an end view of the flexing assembly of FIG. 3A.
Figure 4:
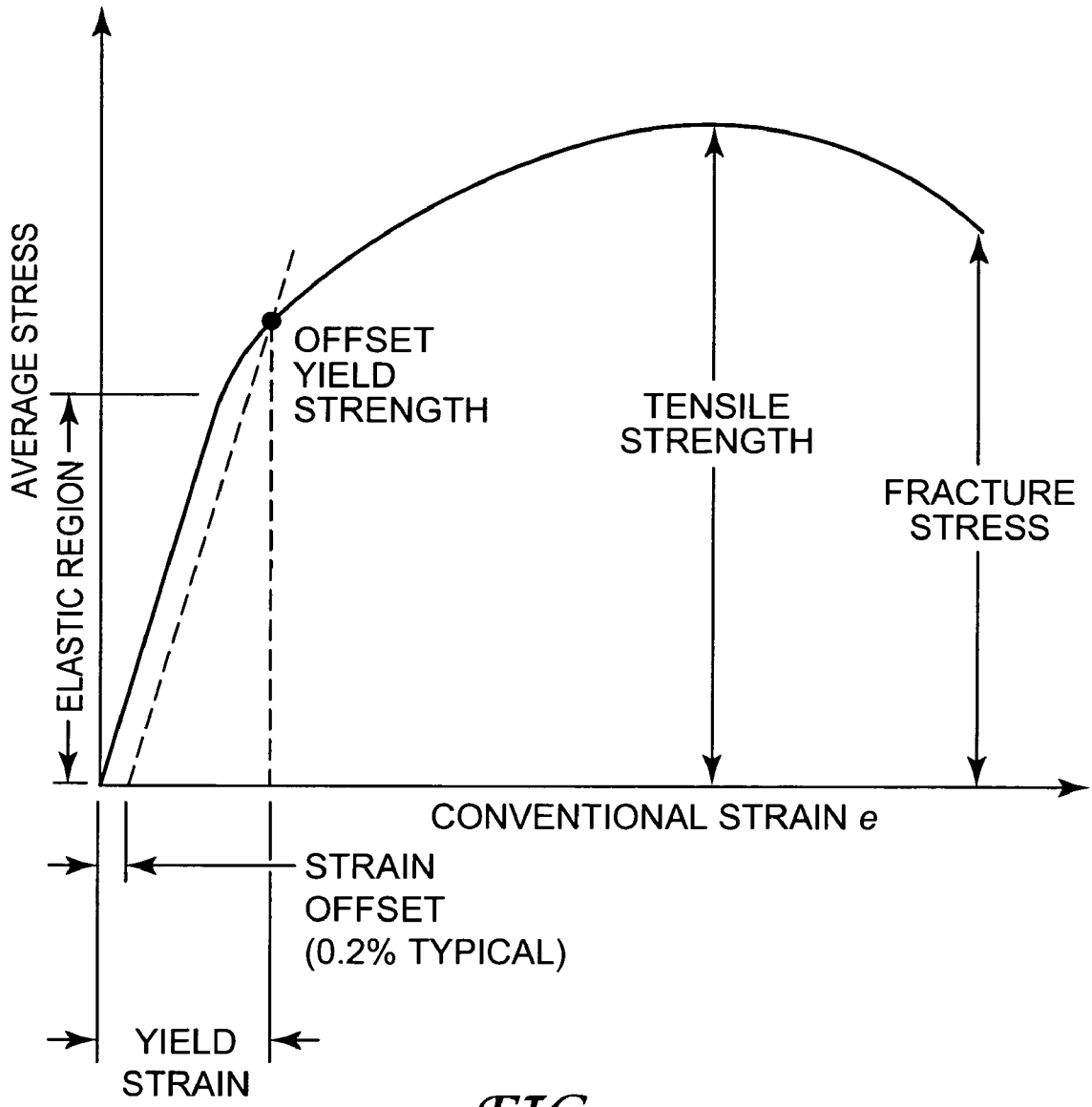
FIG. 4 is an illustration of a stress-strain curve.

Referring to FIGS. 3-3C, an exemplary system 300 for inducing a strain in a cross-direction of a web is illustrated. The system 300 includes a first flexing assembly 310 and a second flexing assembly 320. Each flexing assembly 310, 320 includes a pair of belts 311, 312 and 321, 322 (respectively) along which a web 330 travels. Each flexing assembly 310, 320 is similar to the belt assembly illustrated in FIG. 2, except that the opposed belts (311, 312, for example) are oriented at an angle with respect to one another, and in most situations, the opposed belts are oriented substantially perpendicular to one another. Also, while it is typical that the system 300 for inducing strain in the cross-direction will include two flexing assemblies, a single flexing assembly is possible. Multiple flexing assemblies can allow for a more isotropic stress distribution. The following illustrates how one flexing assembly induces strain in the cross-direction on the web 330.

At the first flexing assembly 310, the web 330 contacts the first belt 311 and travels into the gap where the web 330 is then flipped and turned. The web 330 then contacts the second belt 312. The web 330 (as illustrated in FIG. 2) is formed into a radiused portion in the gap. The size of the radius controls the amount of strain induced in the web, as discussed previously.

The web path created in the first flexing assembly 310 creates a tendency for the web 330 to creep or "walk" along the belt 311 in a direction perpendicular to the line of travel. To minimize the effect of creep, web edge sensors 360 are used to the laterally position the web 330 exiting both flexing assemblies 310 & 320. Lateral control is accomplished by adjusting the relative speed of belts 311 and 312 on the first flexing assembly and belts 321 and 322 on the second flexing assembly 320. Controller 350, based on feedback from the web edge sensors 360, independently adjusts relative belt speeds.

The systems 100, 200, and 300 described above can be used as an independent system and can also be integrated into a machine for processing a web. Such integration would allow curl to be removed from or added to a web in addition to having other modifications being done to the web, such as coating, converting, or printing, or combinations thereof.

An advantage of the invention of the present disclosure is that a web can be flexed without any contact of the surface of the web that is not in contact with the web handling assemblies. For example, many abrasive products are made by direct coating. In direct coating, backings are placed under high tension and temperature, which results in a large induced strain. The coating on the backing usually has negligible strain, which can approach zero strain. If the induced strain in the backing is not removed, the resulting coated abrasive product will have curl.

The curl can be removed or reduced by passing the direct-coated product in web form through the systems described above. A web path can be created such that the coated side of the web does not contact the surface of any web handling assembly. The web is then passed through a web path having a radiused portion. Since the coated side of the web does not contact rollers or belts, there is a reduction in the chance that the coated side of the web will be damaged by contact. Also, since the coated side does not contact any surfaces in the system, the amount of wear is reduced or eliminated.

The size (or curvature) of the radiused portion controls the amount of strain that is induced in the web. The radiused portion is sized so that the web material is strained to just beyond its elastic point, thereby insuring the strain induced is a permanent strain. The particular size of the radius will depend on many factors, such as the material properties and thickness of the material (or multi-layer web). Determining the radius to which the web must be flexed to create permanent strain is within the skill and knowledge of one having ordinary skill in the art. The yield stress, that is the point where the web undergoes plastic deformation, can be determined by routine testing, such as that done using a mechanical tester, for example Model 4505, available from INSTRON Co., of Canton, Mass.

If the flexing systems described are used on a printing press, the perforating process could be set up in a customary manner known to those having ordinary skill in the art. A process for flexing a web, as described herein, could be set up upstream or downstream of the perforating process. This process would consist of two closely spaced rotating assemblies, such as the example embodiments of belts or rollers disclosed herein. The rotating assemblies would have a means of holding the web, such as electrostatic pinning, vacuum, mechanical fasteners or adhesive. One of several means could be used to control the radius of the radiused portion. First, one roll could be held at constant speed, and the speed of the other roller could be adjusted. This would allow the loop to be drawn toward the center of the two rollers in order to form a tight loop and thus a curled section of web. The speed of the roller could then be changed to make a large diameter loop and therefore a flat web. The same small loop/large loop cycles could be accomplished at constant speed by holding the loop position constant and adjusting roller gap.

The present disclosure has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the disclosure. Thus, the scope of the present disclosure should not be limited to the exact details and structures described herein, but rather by the structures described by the language of the claims, and the equivalents of those structures.

What is claimed is:

1. A system for flexing a web in a cross-direction, the system comprising:

a web handling apparatus having a web path, wherein the web path includes means for flexing the web to induce a plastic strain in the cross-direction of the web, wherein the means for flexing the web includes a belt assembly including a first belt and a second belt, the first belt including a first surface having a first line of travel and the second belt including a second surface having a second line of travel, wherein the first and second lines of travel are oriented at an angle with respect to one another.

2. The system of claim 1, wherein the first and second lines of travel are substantially perpendicular.

3. The system of claim 1, further including control means for positioning the web within the belt assembly.

4. A system for imparting permanent cross-directional strain in a web comprising:

a web handling apparatus including a first flexing assembly, the first flexing assembly including a first belt and a second belt and a gap therebetween; and a web path formed through the first flexing assembly, the web path including;

a first portion along the first belt, a second portion along the second belt and a third portion in the gap between the first and second belts, wherein the third portion includes a radiused segment including a radius, the radius being sufficiently small to impart a permanent strain in the web; and wherein the direction of travel of the first portion of the web path is angled with respect to the direction of travel of the second portion of the web path.

5. The system of claim 4, wherein the first portion of the web path is substantially perpendicular to the second portion of the web path.

6. The system of claim 4, further including positioning means for controlling the position of the web as it passes through the web path.

7. The system of claim 6, wherein the positioning means includes a first edge sensor for sensing the position of the web exiting the first portion and a second sensor for sensing the position of the web as it exits the second portion.

8. The system of claim 4, further wherein the gap is adjustable when the web is passing through the web path.

9. The system of claim 4, further including means for holding the web against the first and second belts.

10. The system of claim 9, wherein the means for holding is selected from the group consisting of a mechanical engagement assembly, air pressure, electrostatic pinning, adhesive or vacuum.

11. The system of claim 10, wherein the mechanical engagement assembly is a hook and loop assembly.

* * * * *